United States Patent [19]

Wimmer

[11] Patent Number: 4,822,317

[45] Date of Patent: Apr. 18, 1989

[54] UNDERGARMENT HAVING BRASSIERE AND ABDOMINAL SUPPORT SECTIONS

[76] Inventor: Shirley A. Wimmer, 501 E. Lanier, Kirbyville, Tex. 75956

[21] Appl. No.: 132,126

[22] Filed: Dec. 14, 1987

[51] Int. Cl.[4] ..... A41C 3/08

[52] U.S. Cl. ..... 450/14; 450/13; 450/16; 450/18; 450/85; 450/155

[58] Field of Search ..... 450/14, 16, 18, 155, 450/85, 13; 2/67, 268

[56] References Cited

U.S. PATENT DOCUMENTS

| | | | |
|---|---|---|---|
| 1,068,268 | 7/1913 | Patterson | 450/113 |
| 1,828,015 | 10/1931 | Allebach | 450/155 X |
| 2,021,033 | 11/1935 | Thomas | 450/33 |
| 2,023,701 | 12/1935 | Rosenfield | 450/8 |
| 2,126,591 | 8/1938 | Voss | 450/13 |
| 2,136,768 | 11/1938 | Willis et al. | 450/13 |
| 2,250,807 | 7/1941 | Lunney | 450/113 |
| 2,333,268 | 11/1943 | Moon | 450/13 |
| 2,469,793 | 5/1949 | Siegel | 450/155 |
| 2,743,449 | 5/1956 | Sheldon | 450/113 |
| 3,154,787 | 11/1964 | Newman | 2/268 X |
| 3,273,563 | 9/1966 | Bonang | 450/155 |
| 4,005,715 | 2/1977 | Moore | 450/155 |
| 4,202,343 | 5/1980 | Ichelson | 450/13 |
| 4,575,874 | 3/1986 | Johnson | 2/268 |

FOREIGN PATENT DOCUMENTS

| | | | |
|---|---|---|---|
| 79967 | 2/1920 | Fed. Rep. of Germany | 450/155 |

*Primary Examiner*—Werner H. Schroeder
*Assistant Examiner*—Jeanette E. Chapman
*Attorney, Agent, or Firm*—Stephen T. Belsheim

[57] ABSTRACT

The invention relates to a maternity undergarment having a brassiere and a rectangular abdominal support section. The above combination further includes a means to detachably connect the brassiere section to abdominal section, and the connecting means includes four adjustable strap members connected to and extending from the corners of the abdominal section and the bottom front and near edges of the brassiere section.

2 Claims, 1 Drawing Sheet

UNDERGARMENT HAVING BRASSIERE AND ABDOMINAL SUPPORT SECTIONS

BACKGROUND OF THE INVENTION

The invention pertains to undergarments for use by a woman and in particular, to a maternity undergarment for use by a pregnant womman having a brassiere portion and abdominal support portion.

In the past, garments have been designed to be utilized by pregnant women to help support their protruding abdomen caused by the pregnancy. For example, U.S. Pat. No. 2,369,793 Siegel is directed to a figure-free maternity suspender that includes front and back shoulder straps which are combined with an adjustable strap for the abdomen. However, the structure depicted in the Siegel patent does not show a maternity undergarment containing both a brassiere portion and a portion for supporting the abdomen.

U.S. Pat. No. 3,273,563 to Bonang discloses a maternity girdle. Yet, again, the structure depicted in Bonang does not show a maternity undergarment having a brassiere portion and an abdominal support portion.

U.S. Pat. No. 2,743,449 to Sheldon discloses a maternity garment designed to support the abdomen. Yet, the maternity garment of Sheldon does not show an undergarment having both a brassiere portion and an abdominal support portion.

U.S. Pat. No. 2,250,807 to Lunney shows an undergarment having an abdomen supporting cup and means for suspending the load imposed on the cup from the shoulders and back of the wearer. However, the supporter of Lunney does not disclose or show maternity undergarment having a brassiere portion and an abdominal support portion.

U.S. Pat. No. 2,201,033 to Thomas and U.S. Pat. No. 2,023,701 to Rosenfeld appear to show an undergarment having a brassiere section and another section designed to give a pleasing cosmetic appearance to the abdomen. Neither one of the structures disclosed by the Thomas patent or the Rosenfeld patent are directed to maternity garments wherein the abdominal support is intended to support the abdominal protrusion caused by a pregnancy.

It is apparent, that heretofore, there has not existed a maternity undergarment for a pregnant woman having both a brassiere portion and an abdominal support portion for supporting the protruding abdominal region. As can be appreciated, it would be highly desirable to provide such undergarment.

SUMMARY OF THE INVENTION

It is an object of the invention to provide an improved maternity undergarment for use by a pregnant woman.

It is another object of the invention to provide an improved maternity undergarment having a brassiere portion connected to an abdominal support portion.

In one form thereof, the invention is a maternity undergarment comprising a brassiere, and an abdominal support comprising an elongate member defining four corners. A strap extends from each corner and is attached to the brassiere, so that the weight of the abdomen is carried by the shoulders of the wearer.

In another form thereof, the invention is a maternity undergarment comprising a brassiere portion for supporting the breasts, and an abdominal support portion positioned in a supporting position relative to the protruding abdomen, and means for detachably connecting the abdominal support portion to the brassiere portion.

The above-mentioned and other features and objects of the invention and the manner of attaining them will become more apparent and the invention itself will be best understood by reference to the following description of an embodiment of the invention taken in conjunction with the accompanying drawings.

DETAILED DESCRIPTION OF A SPECIFIC EMBODIMENT

Figure 1:
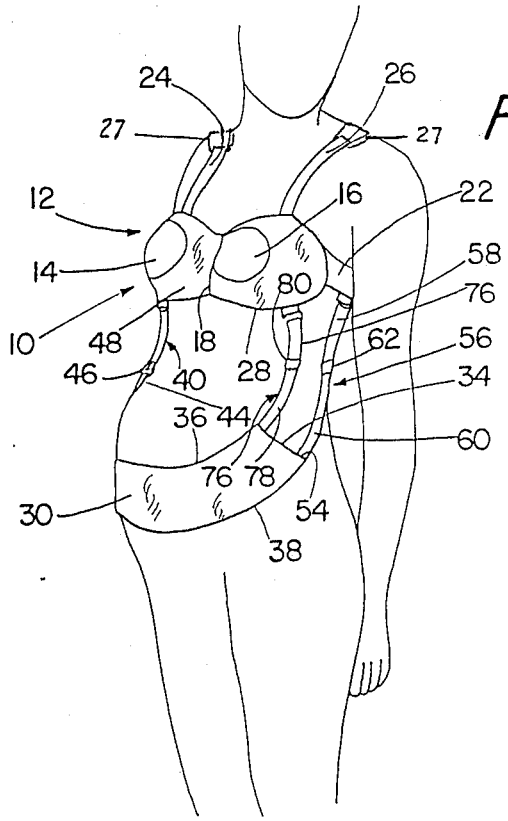
FIG. 1 is a perspective view of a specific embodiment of the invention as worn by a pregnant woman.
Figure 3:
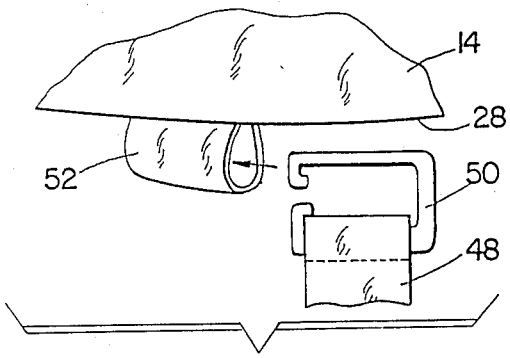
FIG. 3 is a partial view illustrating the connection between the straps of the abdominal support and the brassiere portion.
Figure 2:
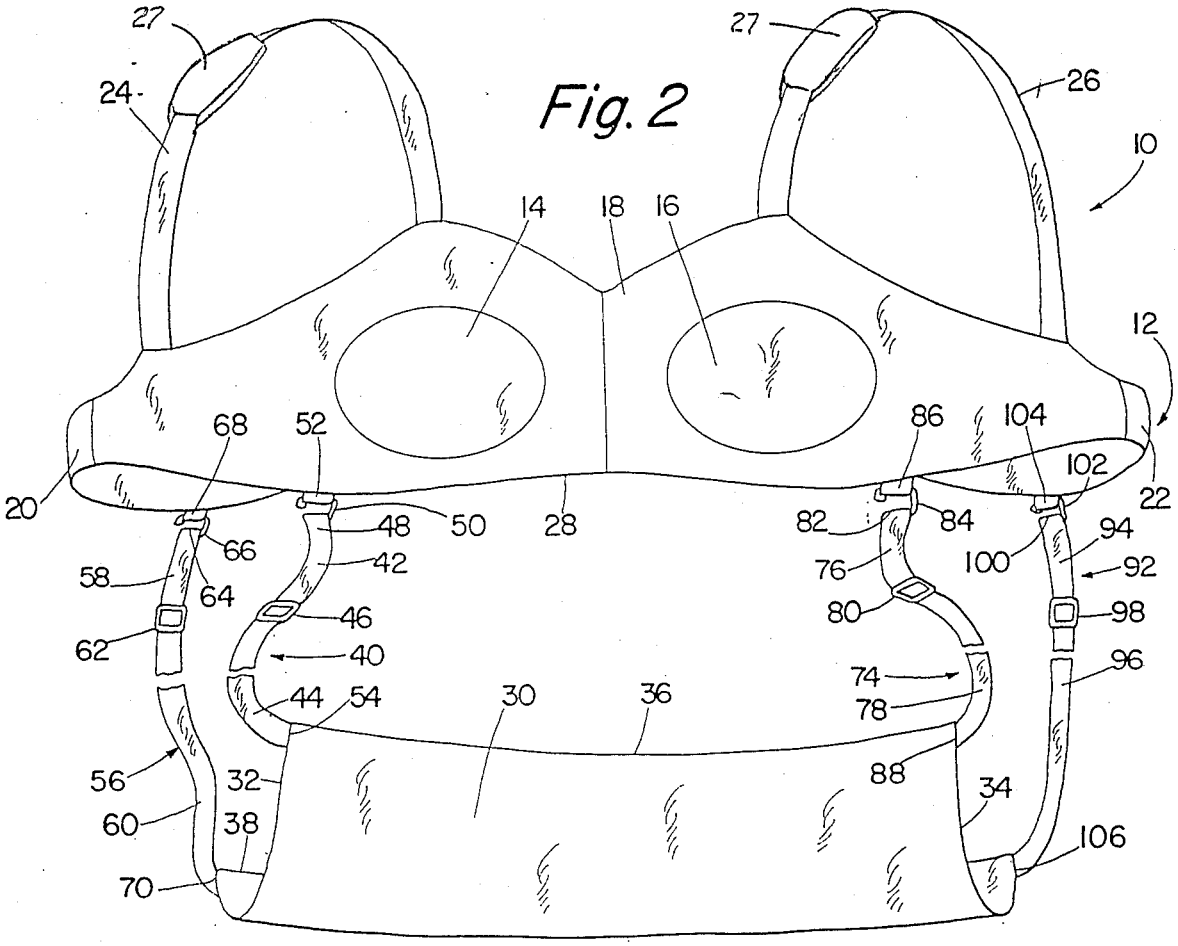
FIG. 2 is a perspective view of a specific embodiment of the invention of FIG. 1.

Referring to the drawings, the specific embodiment of the maternity undergarment is generally designated as 10. Undergarment 10 includes a brassiere portion 12 having a pair of cup portions 14 and 16 and a mediate portion 18 joining together cup portions 14 and 16. Brassiere portion 12 further includes end portions 20 and 22 which when connected together at their distal ends permit the brassiere to be worn by the woman. Brassiere portion 12 further includes a pair of straps 24 and 26.

Each strap 24,26 has a pad 27 slidably connected thereto. Pad 27 can be selectively positioned on the straps 24, 26 to accommodate women of various sizes. The function of pad 27 will be described hereinafter.

Brassiere portion 27 includes a bottom edge 28 along the entire length thereof.

The maternity undergarment 10 further includes an abdominal support 30 which is of a generally rectangular shape so as to have a pair of oppositely disposed short edges 32 and 34 and a pair of oppositely disposed long edges 36 and 38. Although not intended as a limitation, support 30 can be made from a durable cloth fabric such as cotton. Support 30 defines four corners from each of which extends a strap.

Strap 40 includes a top section 42 and a bottom section 44 joined together by an adjustable connector 46. The top end 48 of top section 42 includes a hook 50 that fits through a correspondingly positioned loop 52 attached to the bottom edge 28 of the brassiere portion. As can be appreciated, this provides for a detachable connection between the support and the brassiere. Bottom section 44 includes a bottom end 54 at which strap 40 is permanently secured to support 30.

Strap 56 includes a top section 58 and a bottom section 60 joined together by an adjustable connector 62. The top end 64 of top section 58 includes a hook 66 that fits through a correspondingly positioned loop 68 attached to the bottom edge 28 of the brassiere 12. As can be appreciated, this provides for detachable connection of the support 30 to the brassiere 12. Bottom section 60 includes a bottom end 70 at which strap 56 is permanently secured to support 30.

Strap 74 includes a top section 76 and a bottom section 78 joined together by an adjustable connector 80. The top end 82 of top section 76 includes a hook 84 that fits through a correspondingly positioned loop 86 attached to the bottom edge 28 of the brassiere 12. As can be appreciated, this provides for detachable connection of the support 30 to the brassiere 12. Bottom section 78 includes a bottom end 88 at which strap 74 is permanently secured to support 30.

Strap 92 includes a top section 94 and a bottom section 96 joined together by an adjustable connector 98. The top end 100 of top section 94 includes a hook 102 that fits through a correspondingly positioned loop 104 attached to the bottom edge 28 of the brassiere 12. As can be appreciated, this provides for detachable connection of the support 30 to the brassiere 12. Bottom section 96 includes a bottom end 106 at which strap 92 is permanently secured to support 30.

Although not intended as a limitation, the straps 40, 56,74,92 can be inelastic and made from a durable fabric such as cotton.

As can be seen when viewing FIG. 1, the undergarment 10 has a brassiere portion 12 which is worn in a conventional fashion by the wearer. The abdominal support portion 30 contains straps 40, 56,74 and 92 which are adjustable so as to accommodate women of different sizes. When worn, the abdominal support 30 is positioned underneath of the abdomen and the support 30 is connected to the brassiere portion 12. As can be appreciated, the weight of the abdomen is carried by the shoulders and back of the wearer therefore providing a benefit to the wearer.

Pad 27 cushions the weight carried by the support so as to make the wearer more comfortable. By providing pad 27, the straps 24,26 will not cut into the wearer under the weight carried by the support.

While there have been described above the principles of this invention in connection with a specific device, it is to be clearly understood that this description is made only by way of example and not as a limitation to the scope of the invention.

What is claimed is:

1. A maternity undergarment for use by a pregnant woman having a protruding abdomen comprising;

a brassiere frontal portion for supporting the breasts of the woman, said frontal portion including a bottom edge, and a brassiere end portion extending from the opposite ends of the frontal portion, and forming the rearward portion an abdominal support portion positioned in a supporting position relative to the protruding abdomen, said abdominal support portion including a generally rectangular-shaped flexible member having four corners; and means for detachably connecting the abdominal support portion to the brassiere portion, said connecting means including an adjustable strap connected to and extending from each one of said corners, the distal end of each strap having a connector secured thereto, a plurality of corresponding brassiere connectors attached to said brassiere whereby each strap is detachably connected to said brassiere at one of said brassiere connectors, a pair of said brassiere connectors attached to the bottom edge of said brassiere frontal portion, and another one of said brassiere connectors attached at each brassiere end portion whereby the weight of the protruding abdomen is supported by the frontal and rearward portions of the brassiere.

2. The undergarment of claim 1 wherein said brassiere frontal portion includes a pair of support straps, each strap has a pad slidably attached thereto.

* * * * *